US006192559B1

(12) United States Patent
Munsell, Jr.

(10) Patent No.: US 6,192,559 B1
(45) Date of Patent: Feb. 27, 2001

(54) SHOELACE FASTENING APPARATUS

(76) Inventor: William P. Munsell, Jr., 2500 Ridgefield Dr., Norman, OK (US) 73069

( * ) Notice: Subject to any disclaimer, the term of this patent is extended or adjusted under 35 U.S.C. 154(b) by 0 days.

(21) Appl. No.: 09/256,025

(22) Filed: Feb. 23, 1999

(51) Int. Cl.[7] ..... A43C 7/00; F16G 11/00

(52) U.S. Cl. ..... 24/712.1; 24/712.2; 24/712.9; 24/128; 24/130

(58) Field of Search ..... 24/712, 712.1, 24/712.2, 712.9, 713.1, 713.6, 713, 714, 573.1, 128, 130; 36/50.1

(56) References Cited

U.S. PATENT DOCUMENTS

| | | | | |
|---|---|---|---|---|
| 264,302 | | 9/1882 | Joyce . | |
| 267,218 | | 11/1882 | Joyce . | |
| 309,981 | | 12/1884 | Quentell . | |
| 0,541,729 | * | 6/1895 | Dillin | 24/128 |
| 783,782 | | 2/1905 | Gruener et al. . | |
| 1,280,984 | | 10/1918 | Goslee . | |
| 1,363,693 | | 12/1920 | Swanson . | |
| 1,442,468 | | 1/1923 | Cochrane . | |
| 1,616,694 | | 2/1927 | Hoppe . | |
| 1,827,424 | | 10/1931 | Ellsworth . | |
| 2,164,123 | | 6/1939 | Rio . | |
| 2,229,471 | | 1/1941 | Powers . | |
| 2,612,135 | * | 9/1952 | Iny | 24/712.1 |
| 2,861,314 | * | 11/1958 | Applebaum | 24/712.2 |
| 2,914,830 | | 12/1959 | Peck | 24/120 |
| 3,408,702 | | 11/1968 | Harley | 24/128 |
| 3,636,594 | | 1/1972 | Faivre | 24/73 ES |
| 3,822,445 | | 7/1974 | Feng | 24/266 |
| 3,834,061 | * | 9/1974 | Klein | 24/128 |
| 3,988,810 | | 11/1976 | Emery | 24/128 R |
| 5,158,428 | * | 10/1992 | Gessner et al. | 24/712.9 |
| 5,335,400 | * | 8/1994 | Sales | 24/712.1 |
| 5,467,511 | * | 11/1995 | Kubo | 24/712.1 |
| 5,542,462 | | 8/1996 | Elsenheimer et al. | 160/178 |
| 5,613,283 | | 3/1997 | Yusfan | 24/713 |

FOREIGN PATENT DOCUMENTS

| | | | | |
|---|---|---|---|---|
| 0891065 | * | 9/1953 | (DE) | 24/712.1 |
| 0309684 | * | 10/1971 | (RU) | 24/128 |

* cited by examiner

*Primary Examiner*—Victor N. Sakran
(74) *Attorney, Agent, or Firm*—McAfee & Taft

(57) ABSTRACT

A shoelace locking apparatus. The apparatus comprises a body attachable to a first end of a shoelace and a cup. The body defines a laterally opening locking passage therein for receiving a second end of the shoelace. The cup may be integral with the body or with a separate extension component. By tying a knot in a desired location in the second end of the shoelace and stretching the lace, the second end of the lace may be moved into an engaged position in which tension in the stretched lace tends to maintain the knot in the cup. The apparatus may also comprise a lock attachable to the second end of the shoelace such that the lock is also positioned in the cup and rotatable to a locking position preventing undesired longitudinal movement of the lock and shoelace.

30 Claims, 3 Drawing Sheets

SHOELACE FASTENING APPARATUS

BACKGROUND OF THE INVENTION

1. Field of the Invention

This invention relates to fastening or locking devices for shoelaces, and more particularly, to a shoelace fastening apparatus for quickly fastening and releasing the two ends of a shoelace without the necessity of tying a knot with the ends.

2. Description of the Prior Art

It is well known that shoelaces require tying and untying the two ends thereof at every use, and many times the laces come undone prematurely which, of course, is not desired. Also, tying of shoelaces is difficult or impossible for some wearers. For example, parents may be required to spend time and exertion tying young children's laces. Once tied, children may play with the knot, step on a lace end, or otherwise cause the laces to work free through normal walking. For children and adults, laces which come undone prematurely represent at best more work to retie and at worst an opportunity for a tripping accident. Also, persons with problems with manual dexterity, such as arthritis sufferers, may find tying shoelaces to be difficult if not impossible. The present invention solves these problems by providing a shoelace fastening device which users can operate with much less effort, dexterity and time than is necessary for tying laces and which eliminates the possibility of premature unfastening.

A variety of devices have been developed for locking shoelaces without requiring the tying thereof. For the most part, these devices are overly complicated such that they are not practical and can necessitate a portion of the apparatus be physically attached to the shoe, thus either requiring that the device be made an integral part of the shoe originally or requiring a permanent modification of the shoe subsequently. The present invention does not require any changes to the shoe itself, but is quickly and easily attached and detached only from the shoelaces. Thus it is applicable to all laced shoes currently in the stream of commerce and easily transferable between pairs of shoes.

A problem with previous quick-release shoelace locks is that they may accidentally become disengaged relatively easily. As with tied laces, if a locking device is too easy to release, young children may take them off when it is desired that they not do so. The present invention solves this problem by providing a locking mechanism which guards against unwanted manipulation by children. This child-proof feature should provide a boon to parents who probably already have their hands full in dealing with young children without being concerned about keeping their shoes on.

Another problem with previous quick-release shoelace locks is that those that are not integral with the shoe may easily come entirely separated from the shoe when not in use. This invention solves that problem by providing a method of attachment to one end of the lace that does not release when the device is not in use, and therefore prevents the unintended separation of the device from the shoe. At the same time, complete separation is possible if desired.

Finally, an optional extension further assists in the manipulation of the device by handicapped users.

SUMMARY OF THE INVENTION

The present invention is a device for fastening and locking shoelaces. Different embodiments are described herein, but all primarily utilize on the tension inherent in a stretched shoelace to hold the apparatus in its engaged position and secondarily utilize mechanically interlocking components to resist tampering.

The invention may be described as an apparatus for connecting ends of a shoelace comprising a body adapted for attachment to a first end of the shoelace and a cup adapted for receiving a knot tied in the second end of the shoelace such that tension in the shoelace tends to hold the knot in the cup. The body defines a laterally opening locking passage therein adapted for receiving a second end of the shoelace. The body further preferably defines a retaining passage therein adapted for receiving the first end of the shoelace therethrough. A knot tied in the first end of the shoelace is prevented from passing through the retaining opening because of the size thereof.

The body may have a protrusion thereon adjacent to the locking passageway for reducing a portion of the locking passage in size and thereby providing resistance to movement of the second end of the shoelace therethrough.

In a first embodiment, the cup is integrally formed with the body and disposed at an end of the locking passage. Normally, when in a locking position, the knot tied in the second end of the shoelace engages a shoulder in the cup. Alternatively, the apparatus may further comprise a lock adapted for attachment to the second end of the shoelace and positionable in the cup. The lock has a locking position substantially preventing inadvertent removal thereof from the cup. As illustrated herein, the body further comprises a lock retainer in the cup, and the lock has a notch thereon. Longitudinal movement of the lock in the cup is possible when the notch is aligned with the lock retainer, and longitudinal movement of the lock in the cup is substantially prevented when the lock is rotated with respect to the body to the locking position. The notch and lock retainer are substantially flat. The lock preferably has a knurled edge thereon.

In a second embodiment, the apparatus further comprises an extension separable from the body and positionable in a locking position adjacent to an end of the locking passage in the body. The cup is integrally formed with the extension. The body defines a recess at an end of the locking passage, and a portion of the extension extends into the recess when in the locking position. Lateral movement of the extension is prevented when the extension is in the engaged position.

The first embodiment of the invention may also be described as an apparatus for connecting ends of a shoelace comprising a body adapted for attachment to a first end of the shoelace and defining a locking passage therein adapted for laterally receiving a second end of the shoelace, and a lock adapted for attachment to the second end of the shoelace and positionable in a locked position in the locking passage. The locking passage comprises a cup in which the lock is positioned when the lock is in the locked position. The locking opening also has an elongated portion extending from the cup. The cup and elongated portion of the locking passage are in communication with a laterally opening slot defined in the body.

The first embodiment of the shoelace locking apparatus of the present invention may also be described as comprising a body defining a first opening therein for longitudinally receiving a first end of the shoelace therethrough, a second opening for receiving a second end of the shoelace therein, and a laterally opening slot in communication with a second opening. The second opening has an elongated portion and an enlarged portion with the enlarged portion being adapted for receiving a knot tied in the second end of the shoelace.

The second end of the shoelace may be moved laterally through the slot into the second opening such that the knot tied in the second end of the shoelace may be subsequently moved longitudinally into the enlarged portion of the second opening. This slot is sized such that lateral movement of the knot therethrough is prevented.

The second embodiment of the shoelace locking apparatus may be described as comprising a body and an extension. The body defines a first opening therein for longitudinally receiving a first end of a shoelace therethrough, a second opening for receiving a second end of the shoelace therein, a recess in communication with an end of the second opening, and a laterally opening slot in communication with the second opening and recess such that the second end of the shoelace may be moved laterally through the slot. The extension is adapted for receiving the second end of the shoelace therethrough and has an enlarged portion for receiving a knot tied in the second end of the shoelace. The extension has a portion adapted for extending into the recess in the body when the extension is in a locking position. The extension is sized such that lateral movement thereof through the lateral opening slot in the body is prevented. Tension in the shoelace tends to hold the extension in the engaged position.

An important object of the present invention is to provide a shoelace fastening apparatus which quickly and easily may be used to tighten and release shoelaces.

Another object is to provide a shoelace fastening device which can be used with any existing laced shoe without reinforcement, retrofitting or modification of the shoe, and which can be easily transferred between shoes.

Another object of the invention is to provide a positive shoelace fastening system that is not susceptible to the forces and dynamics which tend to loosen the slip knots commonly employed when tying shoes.

A further object of the invention is to provide a shoelace fastening device which requires a simple, deliberate action on the part of the user to disengage it.

Another object of the invention is to provide a locking device for preventing young children and toddlers from unfastening their shoes.

Still another object of the invention is to provide a shoelace locking device which is secured to the shoelace even when not in use so that the locking device is not easily lost.

An additional object of the invention is to provide a shoelace locking device which allows an opportunity for fashion statements and/or advertising on shoes as a result of the design of the locking device.

Numerous other objects and advantages of the invention will become apparent as the following detailed description of the preferred embodiments is read in conjunction with the drawings which illustrate such embodiments.

DESCRIPTION OF THE PREFERRED EMBODIMENTS

Different embodiments of the apparatus will now be described. In all of the embodiments, the fastening apparatus of the present invention places the shoestring in tension and uses this tension to hold the apparatus in the engaged position. This is accomplished by positioning a knot in the shoelace in a cup portion of the apparatus. This cup prevents inadvertent removal of the knot therefrom so that the shoelace is positively engaged by the apparatus when the apparatus is in the engaged position and may only be released when the apparatus is placed in an disengaged position.

Figure 1:
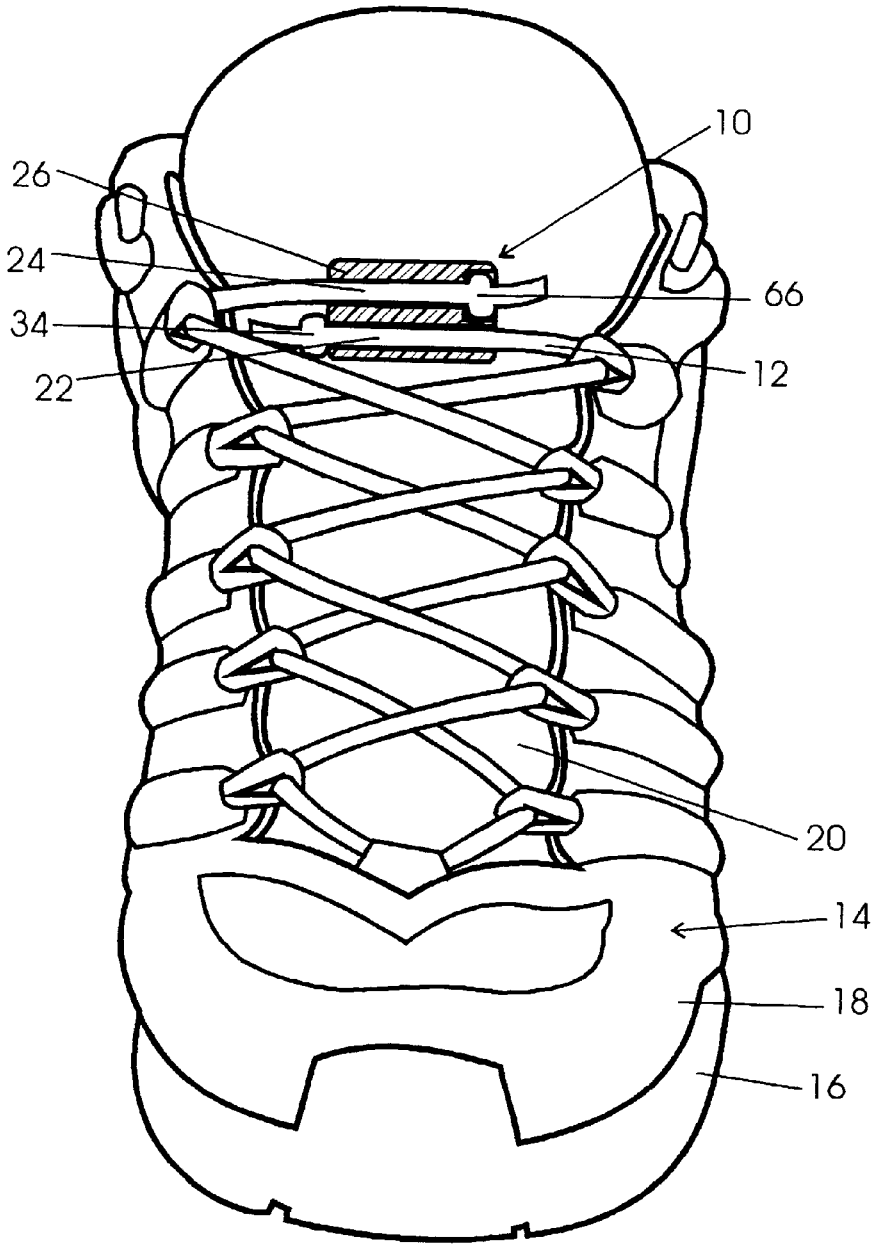
FIG. 1 shows a first embodiment of the shoelace fastening or locking apparatus of the present invention in a locking position on a shoe.

Referring now to the drawings, and more particularly to FIG. 1, a first embodiment of the shoelace fastening or locking apparatus of the present invention is shown and generally designated by the numeral 10. Apparatus 10 is adapted for use in releasably connecting ends of a shoelace 12 of a shoe 14. As shown in FIG. 1, shoe 14 includes a sole 16, an upper 18 and a tongue 20 in addition to shoelaces 12. However, it will be understood by those skilled in the art that shoelace locking apparatus 10 may be used with any of a variety of shoe constructions using laces, and the invention is not intended to be limited to the shoe configuration illustrated in FIG. 1. In other words, apparatus 10 is used to connect a first end 22 and a second end 24 of virtually any shoelace 12.

In the drawings, first embodiment shoelace locking apparatus 10 is shown having a body 26 and a lock 28. As will be further described herein, lock 28 is actually an optional component and is not necessary for a functioning shoelace fastening device. However, lock 28 provides a more secure connection and one which is much less likely to be circumvented by small children.

Referring now to FIGS. 2–6, the details of apparatus 10 will be discussed.

Body 26 is preferably of a one-piece construction. In particular, but not by way of limitation, it is contemplated that body 26 could be easily molded of a plastic material. However, other materials would work just as well. Also, body 26 could be formed of multiple pieces.

Body 26 is illustrated as having a generally parallelepiped configuration. However, body 26 does not have to be any particular shape, and it is contemplated that it can be molded into a variety of shapes to provide ornamentation as a fashion statement or to provide a medium for placing advertising thereon. Regardless of the shape or configuration of body 26, the body preferably defines a first passage or opening 30 extending longitudinally therethrough and a second passage or opening 32 extending longitudinally therethrough and substantially parallel to the first passage.

Figure 6:
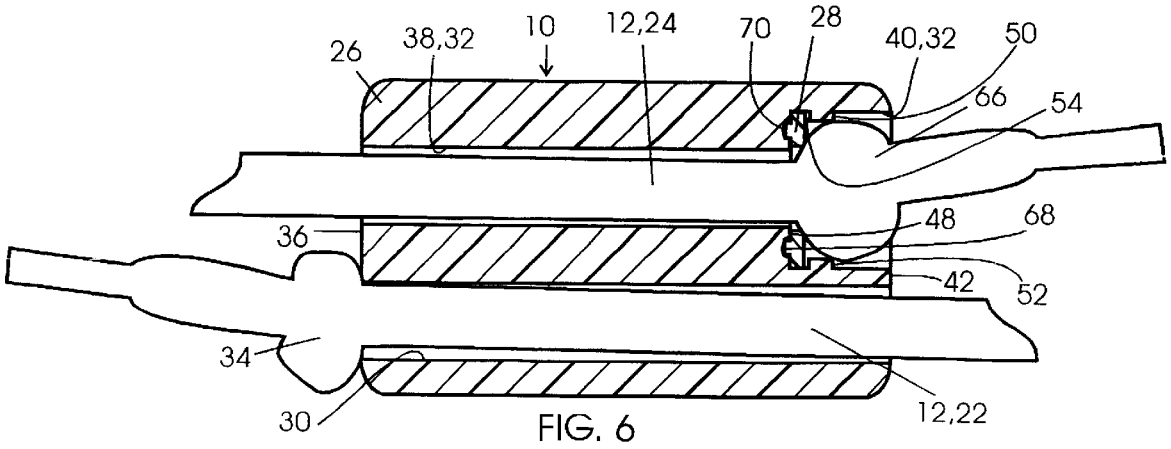
FIG. 6 is a cross section taken along line 6—6 in FIG. 4.

First passage 30 is generally a cylindrical opening adapted for receiving first end 22 of lace 12 therethrough. As seen in FIGS. 1 and 6, by tying a knot 34 in first end 22 of lace 12 after passing the lace through first passage 30, body 26 is retained on the first end of the lace, and knot 34 prevents the lace from being pulled back through because of the engagement of the knot with a first end 36 of body 26. Thus, first passage 30 may be referred to as retaining passage 30.

Second passage 32 comprises an elongated portion 38 and an enlarged portion 40 which is adjacent to a second end 42 of body 26. Enlarged portion 40 may also be referred to as a cup 40 which is integrally formed with body 26. The cup may also be in an extension component separable from the body, as described in the second embodiment herein.

Figure 4:
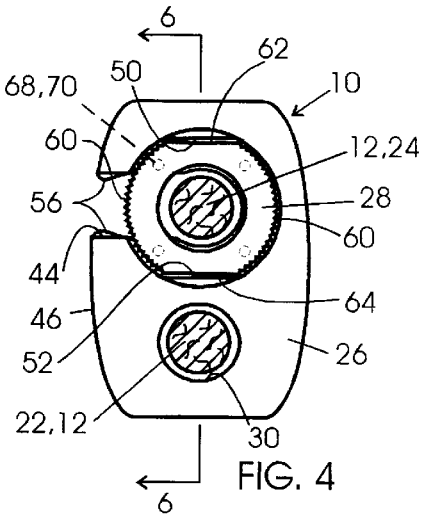
FIG. 4 is an end view of the first embodiment of the shoelace fastening apparatus showing the lock in an unlocked position.
Figure 5:
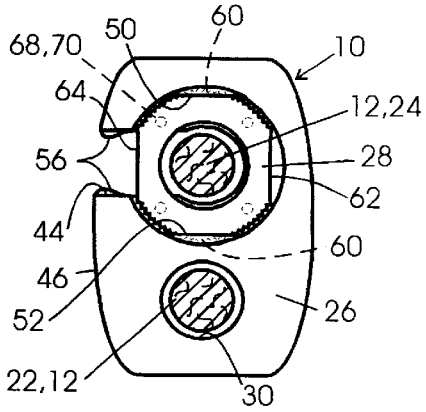
FIG. 5 shows an end view with the lock in the locked position.

As best seen in FIGS. 4 and 5, a longitudinally extending slot 44 provides lateral communication between second passage 32 and side 46 of body 26. Thus, it may be said that second passage 32 opens laterally with respect to body 26.

Slot 44 is shown extending at approximately 90E from side 46, but as an alternative could be at a different angle so that simply pulling sideways on shoelace 12 will not release it. Rather, lace 12 would have to be pulled at the angle of slot 44 with the object to make inadvertent disengagement less likely.

Except where intersected by slot 44, elongated portion 38 of second passage 32 is generally cylindrical. Enlarged portion or cup 40 of the second passage is also cylindrical and has a diameter larger than that of the elongated portion 38. Thus, a shoulder 48, having an annular configuration truncated by slot 44, extends between elongated portion 38 and enlarged portion 40 of second passage 32.

As best seen in FIGS. 4–6, a first or upper lock retainer 50 and a second or lower lock retainer 52 are disposed in enlarged portion or cup 40 of second passage 32. First and second lock retainers 50 and 52 are spaced longitudinally from shoulder 48 such that a gap 54 is defined therebetween. As will be further discussed herein, gap 54 is slightly larger than the thickness of lock 28 so the lock can fit therein. Referring to FIGS. 4 and 5, first and second lock retainers 50 and 52 are substantially flat and extend as chords with respect to the partial circle defined by enlarged portion 40 of second passage 32.

Adjacent to first end 36 of body 26, a pair of facing protrusions 56 extend inwardly in slot 44. As will be further described herein, protrusions 56 serve to lightly retain a portion of second end 24 of shoelace 12 in body 26 adjacent to the protrusions.

Figure 3:
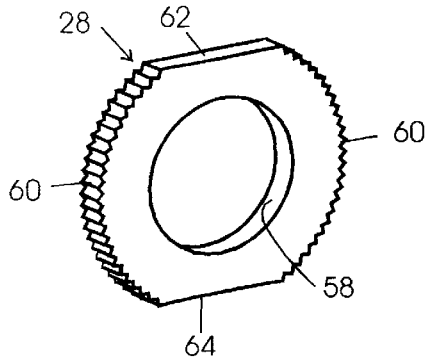
FIG. 3 is a perspective view of an optional lock used in the first embodiment.

Referring now to FIG. 3, lock 28 is generally in the form of a substantially flat disc defining a central hole 58 therethrough. Lock 28 is generally circular with an outer edge 60 which is preferably knurled. A first or upper notch 62 and a substantially parallel second or lower notch 64 truncate the generally circular configuration of lock 28 and extend as chords thereacross. The spacing between first and second notches 62 and 64 is slightly less than the spacing between first and second lock retainers 50 and 52.

In the operation of apparatus 10, regardless of whether lock 28 is used, first end 22 of shoelace 12 is extended longitudinally through first, retaining passage 30 in body 26, and knot 34 is tied in the lace as previously described to attach and retain body 26 to the shoelace.

As previously mentioned, lock 28 is optional. When lock 28 is not used, a knot 66 is formed in second end 24 of shoelace 12 at the desired position. Shoelace 12 is stretched along the length of body 24 with knot 66 clearing second end 42 of body 26, after which second end 24 of the shoelace may be moved laterally inwardly through slot 44 into second passage 32. By tying knot 66 in the appropriate position along the length of second end 24 of shoelace 12, the stretching of lace 12 will result in enough tension being applied to it so that the lace pulls knot 66 toward shoulder 48 in body 26. Knot 66 thus directly engages shoulder 48 in body 26, and is held there by the tension in stretched shoelace 12, thereby retaining second end 24 of shoelace 12 in body 26 and fastening lace 12 on shoe 16. Thus, second passage 32 may be referred to as fastening passage 32. This is a satisfactory arrangement when it is not necessary or desired to more securely lock shoelace 12 into apparatus 10. Removal is accomplished simply by pulling longitudinally outwardly on second end 24 of lace 12, so that knot 66 clears end 42 of body 26, and moving the lace back transversely outwardly through slot 44 so that it is disengaged from body 26.

In the operation of the embodiment of apparatus 10 utilizing lock 28, second end 24 of shoelace 12 is passed through hole 58 in lock 28. As seen in FIGS. 1 and 6, a knot 66 is formed in second end 24 of shoelace 12 to retain lock 28 thereon.

Second end 24 of lace 12 is positioned in body 26 and locked therein in the following manner. Second end 24 of lace 12 is stretched longitudinally beside body 26 (toward the right in FIG. 1) so that knot 66 and lock 28 are beyond second end 42 of body 26. At this point, second end 24 of lace 12 may be moved laterally inwardly into second passage 32 through slot 44. In this way, lock 28 and knot 66 are generally aligned with enlarged portion or cup 40 of second passage 32 so that the lock and knot 66 may be moved longitudinally into the cup (to the left in FIGS. 1 and 6). By tying knot 66 in the appropriate position along the length of second end 24 of lace 12, the stretching of lace 12 will result in enough tension being applied to it so that the lace tends to pull lock 28 and knot 66 toward shoulder 48 in body 26.

Referring now to FIGS. 4 and 6, notches 62 and 64 on lock 28 are aligned with lock retainers 50 and 52 in body 26 so that lock 28 may be moved longitudinally into gap 54. As seen in FIG. 5, lock 28 may be rotated 90E in gap 54 so that notches 62 and 64 are no longer aligned with lock retainers 50 and 52. In FIG. 5, lock 28 is shown after being rotated clockwise 90E, but those skilled in the art will see that the lock could just as easily be rotated counterclockwise. In this locking position, lock retainers 50 and 52 will be seen to prevent longitudinally outward movement of lock 28. Thus, lace 12 is locked on shoe 16, and second passage 32 may be referred to in this embodiment as locking passage 32.

When so engaged, the portion of second end 24 of shoelace 12 adjacent to protrusions 56 is lightly retained in body 26 as previously described. The flexible material of the typical shoelace 12 allows it to be passed fairly easily between protrusions 56, but the lace will not simply fall therethrough.

To release second end 24 of shoelace 12, lock 28 is rotated back 90E in either direction so that notches 62 and 64 are each aligned with one of lock retainers 50 and 52, at which point pulling on the end of the shoelace will move knot 66 and allow lock 28 to pass between retainers 50 and 52 and then longitudinally outwardly through cup 40. Once knot 66 and lock 28 clear end 42 of body 26, second end 24 of shoelace 12 may be moved laterally outwardly through slot 44 so that it is disengaged from body 26.

FIGS. 2 and 4–6 also illustrate another alternate construction. In this embodiment, at least one divot 68 is indented into the surface of shoulder 48 in body 26. As illustrated, there are four such divots 68, but the invention is not intended to be limited to any particular number. A corresponding number of raised bumps 70 are formed on lock 26 in the same spacing as divots 68. At least when lock 28 is positioned in the locking position shown in FIG. 5, bumps 70 on the lock are aligned with divots 68 in body 26 and extend therein to help prevent inadvertent rotation of lock 28 within enlarged portion 40 of second passage 32 in body 26. Thus, in this alternate embodiment, resistance is provided against rotation of lock 28, but this resistance is easily overcome by simultaneously relieving the bearing pressure of the knot 66 on the lock 28 while rotating the lock 28. In this way an advanced level of mental and physical ability is required to rotate the lock 28 while chance movement is substantially eliminated.

With or without divots 68 and bumps 70, a degree of manual dexterity is required to rotate optional lock 28 to its unlocked position. To unlock apparatus 10 with lock 28, one pulls on lace 24 so that knot 66 no longer exerts a longitudinally directed force on lock 28, rotates lock 28 so that notches 62 and 64 are again aligned with lock retainers 50 and 52, and guides lock 28 with knot 66 outwardly from body 26 until both clear the end 42. Adults will be able to carry out these steps in order to move lock 28 to the unlocked position, but small children and toddlers will not as likely be able to do so. Thus, a parent can fasten a child's shoelaces, and the child will be deterred from disengaging the shoelaces and removing the shoes.

Figure 2:
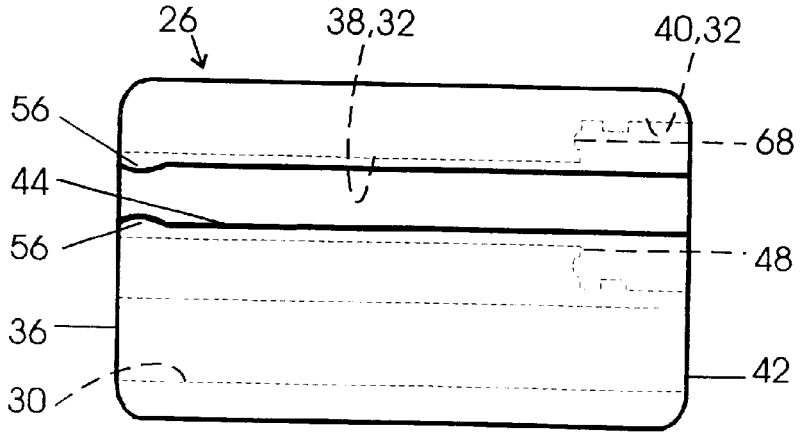
FIG. 2 is a side elevation view of the first embodiment.

In still another variation of apparatus 10, a cap 70 may be positioned over enlarged portion 40 of second passage 32 as shown in phantom lines in FIG. 2 to enclose knot 66 and also lock 28 if present. Cap 70 could be tethered to body 26, such as by being molded as an integral, flexible part of the body or as a separate piece attached thereto.

Figure 9:
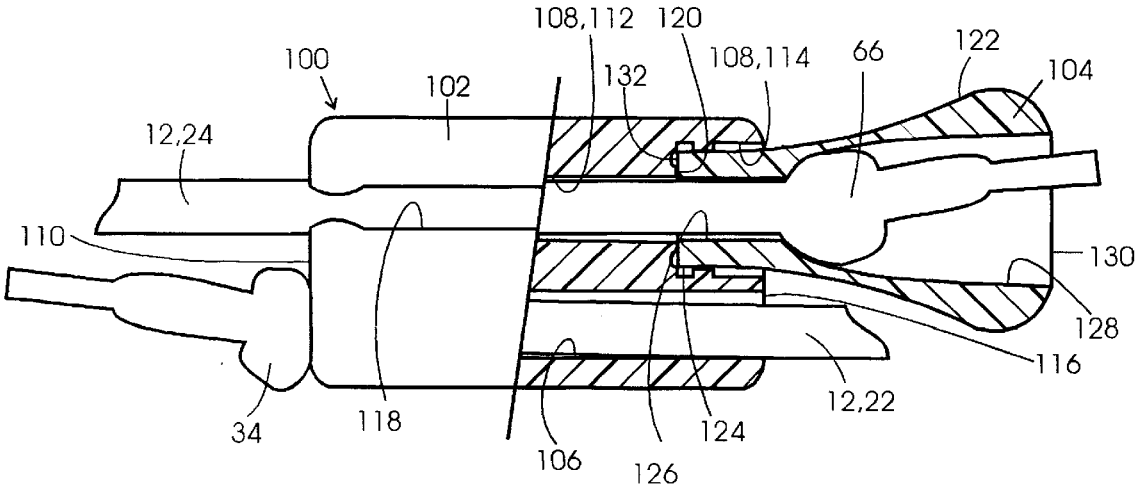
FIG. 9 is a cross section similar to FIG. 6 showing the second embodiment apparatus in a fastening or locking position.

Referring now to FIG. 9, a second embodiment of the shoelace locking apparatus of the present invention is shown and generally designated by the numeral 100. As with first embodiment apparatus 10, second embodiment apparatus 100 is adapted for use in releasably connecting first and second ends 22 and 24 of a shoelace 12.

Apparatus 100 comprises a body 102 and an extension or knob 104. Body 26 is preferably of a one-piece construction, such as molded plastic, but other materials and multiple pieces would also work.

Body 102 is illustrated as having a generally parallelepiped configuration, but does not have to be of any particular shape. It is contemplated that body 26 may be molded into a variety of shapes to provide ornamentation as a fashion statement or to provide a medium for placing advertising thereon. Regardless of the shape or configuration of body 102, the body preferably defines a first passage or opening 106 extending longitudinally therethrough and a second passage or opening 108 extending longitudinally therethrough and substantially parallel to the first passage.

As in first embodiment apparatus 10, first passage 30 in second embodiment 100 is generally a cylindrical opening adapted for receiving first end 22 of lace 12 therethrough. As seen in FIG. 9, by tying a knot 34 in first end 22 of lace 12 after passing the lace through first passage 106, body 102 is retained on the first end of the lace, and knot 34 prevents the lace from being pulled back through because of the engagement of the knot with a first end 110 of body 102. Thus, first passage 106 may be referred to as a retaining passage 106.

Second passage 108 comprises an elongated portion 112 and an enlarged recess 114 adjacent to a second end 116 of body 102. As illustrated in FIG. 9, body 102 is identical to body 26 in first embodiment apparatus 10, and the previously described enlarged portion 40 is the same as recess 114 in the second embodiment. However, the invention is not intended to be limited to the specific body illustrated, and bodies 102 and 26 need not be identical.

A longitudinally extending slot 118 provides lateral communication between second passage 108 and one side of body 102. Thus, it may be said that second passage 108 opens laterally with respect to body 102.

Slot 118 preferably extends at approximately 90E from the side of body 102, but as an alternative could be at a different angle so that simply pulling sideways on shoelace 12 will not release it. Rather, lace 12 would have to be pulled at the angle of slot 118 with the object to make inadvertent disengagement less likely.

Except where intersected by slot 118, elongated portion 112 of second passage 108 is generally cylindrical. Recess 114 is also cylindrical and has a diameter larger than that of elongated portion 112. Thus, a shoulder 120, having an annular configuration truncated by slot 118, extends between elongated portion 112 and recess 114 of second passage 108.

Figure 7:
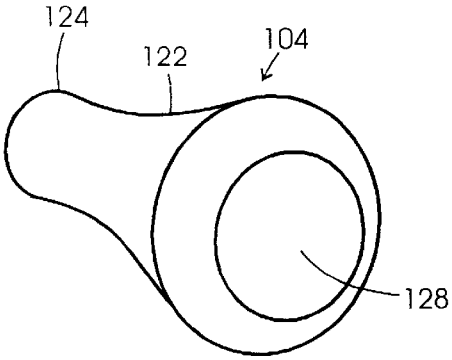
FIG. 7 illustrates a perspective view of an extension in a second embodiment of the shoelace fastening apparatus.
Figure 8:
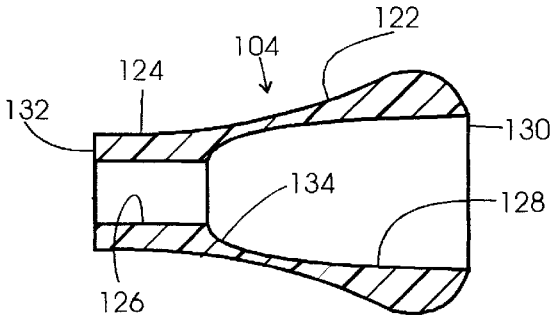
FIG. 8 is a longitudinal cross section of the extension of the second embodiment.

Referring also to FIGS. 7 and 8, extension 104 has a generally conical outer surface 122 extending from a cylindrical outer surface portion 124. Cylindrical outer surface portion 124 is adapted to fit within recess 114, as seen in FIG. 9, when in a locking position, as will be further described herein.

Extension 104 defines a bore 126 therein which is approximately the same size as elongated portion 112 of second opening 108 in body 102. Extension 104 also defines an enlarged opening or cup 128 which opens outwardly at an outer end 130 of the extension. An inner end 132 of extension 104 is adapted for engagement with shoulder 120 and body 102 when apparatus 100 is in the fastening position shown in FIG. 9.

In the operation of second embodiment 100, second end 24 of shoelace 12 is inserted through bore 126 in extension 104. A knot 34 is formed in second end 24 of lace 12 and positioned such that it engages a curvilinear surface 134 in cup 128. That is, knot 66 prevents second end 24 of lace 12 from being pulled back through bore 126 in extension 104.

By grasping extension 104 on conical surface 122 thereof, extension 104 is easily pulled to stretch second end 24 of lace 12 so that the extension clears second end 116 of body 102. Second end 24 of shoelace 12 may then be moved laterally inwardly through slot 118 into second passage 108. Cylindrical outer surface 124 of extension 104 is aligned with recess 114 in body 102, and the extension is released. The tension in stretched shoelace 12 will keep knot 66 engaged with cup 128 and pull cylindrical outer surface 124 of extension 104 into recess 114 such that inner end 132 of the extension engages shoulder 120, thereby placing apparatus 100 in the engaged position shown in FIG. 9. Thus, as with first embodiment 10 and its variations, the tension in shoelace 12 keeps second embodiment apparatus 100 in its engaged position. Disengagement is accomplished simply by pulling on extension 104 and reversing the process.

It will be seen, therefore, that the shoelace locking apparatus of the present invention is well adapted to carry out the ends and advantages mentioned as well as those inherent therein. While presently preferred embodiments of the apparatus have been shown for the purposes of this disclosure, numerous changes in the arrangement and construction of parts may be made by those skilled in the art. All such changes are encompassed without the scope and spirit of the appended claims.

What is claimed is:

1. An apparatus for connecting ends of a shoelace comprising:

a body adapted for attachment to a first end of the shoelace, said body defining a laterally opening locking passage therein extending the length of said body and adapted for laterally receiving a second end of the shoelace; and a cup adapted for receiving a knot tied in the second end of the shoelace such that tension in the shoelace tends to hold the knot in said cup when in an operating position on a shoe.

2. The apparatus of claim 1 wherein said cup is integrally formed with said body and disposed at an end of the locking passage.

3. The apparatus of claim 2 wherein lateral movement of said knot through said locking passage is prevented.

4. The apparatus of claim 1 wherein said body defines a retaining passage therein adapted for receiving the first end of the shoelace therethrough such that a knot tied in the first end of the shoelace is prevented from passing through the retaining opening.

5. The apparatus of claim 1 wherein said body has a protrusion thereon adjacent to said locking passage for reducing a portion of the locking passage in size and thereby providing resistance to movement of the second end of the shoelace laterally therethrough.

6. An apparatus for connecting ends of a shoelace comprising:

a body adapted for attachment to a first end of the shoelace and defining a locking passage therein extending the length of said body and adapted for laterally receiving a second end of the shoelace therethrough; and a lock adapted for attachment to the second end of the shoelace and positionable in a locked position in said locking passage.

7. The apparatus of claim 6 further comprising a cup in which said lock is positioned when said lock is in said locked position.

8. The apparatus of claim 6 wherein:

said cup is integrally formed with said body; and said locking passage has an elongated portion extending from said cup.

9. The apparatus of claim 8 wherein said cup and elongated portion of said locking passage are in communication with a laterally opening slot defined in said body.

10. The apparatus of claim 6 wherein said lock comprises a disc defining a hole therein for receiving the second end of the shoelace therethrough.

11. The apparatus of claim 10 wherein said disc has a knurled outer edge.

12. The apparatus of claim 6 wherein said body defines a retaining opening therein for receiving the first end of the shoelace therethrough.

13. The apparatus of claim 6 wherein:

said cup defines a divot therein;

said lock has a bump extending therefrom; and said bump extends into said divot when said lock is in said locking position.

14. A shoelace locking apparatus comprising a body defining:

a first opening therein for longitudinally receiving a first end of the shoelace therethrough;

a second opening for receiving a second end of the shoelace therein, said second opening having an elongated portion and an enlarged portion, said enlarged portion being adapted for receiving a knot tied in the second end of the shoelace; and a laterally opening slot in communication with said second opening such that the second end of the shoelace may be moved laterally through the slot into the second opening after the knot is tied in the second end of the shoelace such that the knot may be subsequently moved longitudinally into said enlarged portion of said second opening, said slot being sized such that lateral movement of the knot therethrough is prevented.

15. The apparatus of claim 14 further comprising:

a lock defining a hole therein for receiving the second end of the shoelace therethrough, said lock being positionable in said enlarged portion of said second opening in said body such that tension in the shoelace holds said lock in said second opening.

16. The apparatus of claim 15 wherein said lock has a knurled edge.

17. The apparatus of claim 14 wherein said body has a protrusion thereon extending into said slot adjacent to said second opening to reduce a size of a portion of said slot and thereby provide resistance to lateral movement of the second end of the shoelace therepast.

18. A shoelace locking apparatus comprising:

a body defining:

a first opening therein for longitudinally receiving a first end of a shoelace therethrough;

a second opening for receiving a second end of the shoelace therein;

a recess in communication with an end of the second opening; and a laterally opening slot in communication with said second opening and recess such that the second end of the shoelace may be moved laterally through the slot; and an extension adapted for receiving the second end of the shoelace therethrough and having an enlarged portion for receiving a knot tied in the second end of the shoelace, said extension having a portion adapted for extending into said recess in said body when said extension is in a locking position, said extension being sized such that lateral movement thereof through the lateral opening slot in the body is prevented, wherein tension in the shoelace tends to hold the extension in the engaged position.

19. An apparatus for connecting ends of a shoelace comprising:

a body adapted for attachment to a first end of the shoelace, said body defining a laterally opening locking passage therein adapted for receiving a second end of the shoelace;

a cup adapted for receiving a knot tied in the second end of the shoelace such that tension in the shoelace tends to hold the knot in said cup, said cup being integrally formed with said body and disposed at an end of the locking passage; and a lock adapted for attachment to the second end of the shoelace and positionable in said cup, said lock having a locking position substantially preventing inadvertent removal thereof from said cup.

20. The apparatus of claim 19 wherein:

said body further comprises a lock retainer in said cup; and said lock has a notch thereon, such that longitudinal movement of said lock in said cup is possible when said notch is aligned with said lock retainer, and longitudinal movement of said lock in said cup is substantially prevented when said lock is rotated with respect to said body to said locking position.

21. The apparatus of claim 20 wherein said notch and lock retainer are substantially flat.

22. The apparatus of claim 19 wherein said lock has a knurled edge.

23. An apparatus for connecting ends of a shoelace comprising:

a body adapted for attachment to a first end of the shoelace, said body defining a laterally opening locking passage therein adapted for receiving a second end of the shoelace;

a cup adapted for receiving a knot tied in the second end of the shoelace such that tension in the shoelace tends to hold the knot in said cup; and an extension separable from said body and positionable in an engaged position adjacent to an end of said locking passage in said body, wherein said cup is integrally formed with said extension.

24. The apparatus of claim 23 wherein:

said body defines a recess at an end of said locking passage; and a portion of said extension extends into said recess when in the engaged position.

25. The apparatus of claim 24 wherein lateral movement of said extension is prevented when said extension is in the engaged position.

26. An apparatus for connecting ends of a shoelace comprising:

a body adapted for attachment to a first end of the shoelace and defining a locking passage therein adapted for laterally receiving a second end of the shoelace, said body comprising a lock retainer in said locking passage; and a lock adapted for attachment to the second end of the shoelace and positionable in a locked position in said locking passage, wherein:

said lock has a notch thereon;

said lock may be moved longitudinally in said locking opening when said notch is aligned with said lock retainer; and said lock is rotatable to said locked position such that said notch and lock retainer are unaligned and longitudinal movement of said lock in said locking passage is thereby substantially prevented.

27. A shoelace locking apparatus comprising:

a body defining:

a first opening therein for longitudinally receiving a first end of a shoelace therethrough;

a second opening for receiving a second end of the shoelace therein, said second opening having an elongated portion and an enlarged portion, said enlarged portion being adapted for receiving a knot tied in the second end of the shoelace; and a laterally opening slot in communication with said second opening such that the second end of the shoelace may be moved laterally through said slot into said second opening such that the knot tied in the second end of the shoelace may be subsequently moved longitudinally into said enlarged portion of said second opening, said slot being sized such that lateral movement of the knot therethrough is prevented;

said body comprising a lock retainer in said enlarged portion of said second opening; and a lock defining a hole therein for receiving the second end of the shoelace therethrough, said lock being positionable in said enlarged portion of said second opening in said body such that tension in the shoelace holds said lock in said second opening, said lock having a notch thereon such that said lock may be moved longitudinally in said enlarged portion of said second opening in said body when said notch is aligned with said lock retainer, said lock being rotatable in said enlarged portion such that said notch is not aligned with said lock retainer, thereby substantially preventing longitudinal movement of said lock.

28. A shoelace locking apparatus comprising:

a body defining:

a first opening therein for longitudinally receiving a first end of a shoelace therethrough;

a second opening for receiving a second end of the shoelace therein, said second opening having an elongated portion and an enlarged portion, said enlarged portion being adapted for receiving a knot tied in the second end of the shoelace; and a laterally opening slot in communication with said second opening such that the second end of the shoelace may be moved laterally through said slot into said second opening such that the knot tied in the second end of the shoelace may be subsequently moved longitudinally into said enlarged portion of said second opening, said slot being sized such that lateral movement of the knot therethrough is prevented;

wherein said body has a shoulder extending between said elongated and enlarged portions of said second opening in said body; and a lock defining a hole therein for receiving the second end of the shoelace therethrough, said lock being positionable in said enlarged portion of said second opening in said body such that tension in the shoelace holds said lock in said second opening, wherein said lock engages said shoulder when in a locking position.

29. The apparatus of claim 28 wherein:

said shoulder defines a divot therein; and said lock comprises a raised portion thereon facing said shoulder, said raised portion extending into said divot when said lock is in said locking position.

30. A shoelace fastening apparatus comprising a body defining:

a first opening therein for longitudinally receiving a first end of a shoelace therethrough;

a second opening for receiving a second end of the shoelace therein;

a recess in communication with an end of the second opening and adapted for receiving a knot tied in the second end of the shoelace; and a laterally opening slot in communication with said second opening in said recess such that the second end of the shoelace may be moved laterally into and out of the second opening and recess through the slot without untying the knot and move longitudinally so that the knot is placed in the locking position in the recess; whereby, tension is applied to both ends of the shoelace which tends to hold the body in the operating position.

* * * * *